US008757367B2

(12) United States Patent
Winterton et al.

(10) Patent No.: US 8,757,367 B2
(45) Date of Patent: Jun. 24, 2014

(54) PRESSURE-VENTING CONTAINER FOR DISINFECTION AND STORAGE OF CONTACT LENSES

(75) Inventors: Lynn Cook Winterton, Fort Worth, TX (US); Jack C. White, Alpharetta, GA (US)

(73) Assignee: Novartis AG, Basel (CH)

( * ) Notice: Subject to any disclaimer, the term of this patent is extended or adjusted under 35 U.S.C. 154(b) by 27 days.

(21) Appl. No.: 13/328,223

(22) Filed: Dec. 16, 2011

(65) Prior Publication Data

US 2012/0152284 A1 Jun. 21, 2012

Related U.S. Application Data

(60) Provisional application No. 61/424,126, filed on Dec. 17, 2010.

(51) Int. Cl.
*A45C 11/04* (2006.01)

(52) U.S. Cl.
USPC ..... 206/5.1; 215/307; 215/343

(58) Field of Classification Search
CPC ..... B65D 2543/0037; B65D 51/16; B65D 2543/0099; B65D 2251/023; B65D 2543/00416; A65C 11/005
USPC ..... 206/5.1; 220/296, 293, 288; 215/344, 215/343, 342, 341, 329, 307, 316
See application file for complete search history.

(56) References Cited

U.S. PATENT DOCUMENTS

| | | | | |
|---|---|---|---|---|
| 4,036,386 | A | 7/1977 | Nishioka | |
| 4,089,434 | A | 5/1978 | Tagalakis | |
| 4,637,919 | A | 1/1987 | Ryder | |
| 4,750,610 | A | 6/1988 | Ryder | |
| 4,993,572 | A | 2/1991 | Ochs | |
| 4,996,027 | A | 2/1991 | Kanner | |
| 5,197,621 | A * | 3/1993 | Bartl et al. | 215/331 |
| 5,250,266 | A | 10/1993 | Kanner | |
| 5,366,078 | A | 11/1994 | Braun | |
| 5,458,252 | A * | 10/1995 | Logel | 215/271 |
| 5,462,186 | A * | 10/1995 | Ladina et al. | 215/330 |
| 5,558,846 | A | 9/1996 | Alvord | |
| 5,871,111 | A * | 2/1999 | Pfefferkorn et al. | 215/307 |
| 6,945,389 | B2 | 9/2005 | Scherer | |
| 2004/0256348 | A1 * | 12/2004 | Stevens et al. | 215/262 |
| 2007/0272649 | A1 * | 11/2007 | Dreyer et al. | 215/329 |
| 2008/0128380 | A1 * | 6/2008 | Denner et al. | 215/44 |
| 2009/0301986 | A1 * | 12/2009 | Phelan et al. | 215/252 |

FOREIGN PATENT DOCUMENTS

| | | | |
|---|---|---|---|
| EP | 0476937 | A2 | 9/1991 |
| WO | 9846278 | A1 | 10/1998 |
| WO | 9921774 | A1 | 5/1999 |

OTHER PUBLICATIONS

International Search Report dated May 29, 2012 in International Application No. PCT/US2011/065430.
Written Opinion of the International Searching Authority dated May 29, 2012 in International Application No. PCT/US2011/065430.

* cited by examiner

*Primary Examiner* — David Fidei
(74) *Attorney, Agent, or Firm* — Sheng-Hsin Hu

(57) ABSTRACT

A lens care system and method for venting gas to release pressure from a container, such as generated in peroxide-based lens treatment. A seal formed between a deformable cap and a container cup prevents release of liquid, but deformation of the cap under the influence of pressure generated within the container temporarily releases the seal to permit venting of gas.

16 Claims, 5 Drawing Sheets

PRESSURE-VENTING CONTAINER FOR DISINFECTION AND STORAGE OF CONTACT LENSES

This application claims the benefit under 35 USC §119 (e) of U.S. provisional patent application No. 61/424,126 filed Dec. 17, 2010, herein incorporated by reference in its entirety.

TECHNICAL FIELD

The present invention relates generally to the field of lens care, and more particularly to a container for disinfection and storage of contact lenses.

BACKGROUND

Contact lens containers of various styles and functionality are utilized for storing, cleaning and/or disinfecting contact lenses. In some lens containment and care systems a hydrogen peroxide based lens care solution is used, wherein the contact lenses to be cleaned and/or disinfected are deposited in contact with the hydrogen peroxide solution for a certain period of time, in order that cleaning and/or disinfecting of the contact lenses can take place to a satisfactory extent. During the duration of the cleaning or disinfecting process, the hydrogen peroxide ($H_2O_2$) in the lens care solution may be broken down into water ($H_2O$) and oxygen ($O_2$), for example with the aid of catalase tablets which give a delayed release of the catalase which initiates and accelerates the decomposition process, or a catalyst element or disk. The term "catalysts" means any material that catalyses the decomposition of hydrogen peroxide. The catalyst is preferably a solid, and more preferably a metal or metal oxide of transition metal from Periods 3 to 12 of the Periodic Table, or one of the lanthanide elements. Particularly preferred is platinum, more particularly platinum oxide. Different transition metals follow different reaction pathways in the decomposition of hydrogen peroxide. For example, applicants believe the peroxide is decomposed using platinum ion as catalyst following the following mechanism:

$$2H_2O_2+Pt^{n+}\rightarrow 2H_2O+O_2+Pt^{n+}.$$

After completion of the decomposition process, cleaning and/or disinfecting is finished and the contact lenses may be removed from the container and inserted into the eye either directly or after treating with a rinsing solution.

The contact lens containers utilized in such lens care systems typically comprise closable baskets, which open to receive the contact lenses to be cleaned and close to retain the lenses during treatment. The baskets are typically part of a contact lens holder component, which in turn can be connected to the cap of a contact lens container. Before the cap is placed onto the container cup, the container cup is dosed to a fill level with a hydrogen peroxide lens care solution. A catalase tablet, which gives delayed release of catalase, can be added to the container cup before or after adding the hydrogen peroxide solution. Finally, the contact lens holder containing the lenses to be treated is immersed into the hydrogen peroxide solution in the container cup, and the container is closed by screwing the cap onto the container cup.

The closure of the cap on the container cup may form a water-tight seal, to prevent leakage of the cleaning solution. The contact lenses are allowed to remain immersed in the solution for a period of time sufficient to complete the specified cleaning and/or disinfecting process. The oxygen produced from decomposition of hydrogen peroxide in the cleaning solution typically must be allowed to discharge from the container in some manner. U.S. Pat. No. 6,945,389, incorporated herein by reference, discloses various known gas discharge mechanisms.

Continued improvements to lens care systems for cleaning, disinfecting and storing contact lenses are desired. It is to the provision of improved lens care systems that the present invention is primarily directed.

SUMMARY

In example forms, the present invention provides an improved lens care system for cleaning, disinfecting and storing contact lenses. Example embodiments of a lens care system according to the invention include a single-piece, integrally molded cap for attachment onto a single-piece, integrally molded container cup, to form a liquid-tight seal against leakage of the cleaning solution. The lens care system allows discharge of gas generated from the cleaning process without need for the provision of separate vent and/or seal components. The system instead utilizes pressure generated by the decomposition of the lens care solution to resiliently and temporarily deform or flex one or both of the cap and/or container cup to allow periodic release or "burping" of gas generated by the cleaning and disinfecting process. Elimination of the need for separate vent and/or seal components may enable more efficient and cost-effective manufacture, as well as improved operation.

In one aspect, the present invention relates to a lens care container including a container cup defining an interior chamber accessible through an opening bounded by a rim. The lens care container preferably further includes a cap removably attachable to the container cup to cover the opening. The cap preferably includes a deformable panel and a sealing lip. The sealing lip preferably engages and seals against the rim of the container cup when the deformable panel is substantially undeformed and allows venting of gas between the sealing lip and the rim of the container cup when the panel is deformed.

In another aspect, the invention relates to a lens care container comprising a container cup consisting essentially of a unitary, integral molding, and defining an interior chamber for receiving a lens care solution. The lens care container preferably also includes a cap for removable attachment to the container cup to seal the lens care solution within the interior chamber, the cap consisting essentially of a unitary, integral molding. An interface formed between the cap and the container cup upon closure of the cap onto the container permits venting of gas from the interior chamber.

In still another aspect, the invention relates to a method of treating a contact lens. The method preferably includes the steps of providing a lens care container comprising a container cup and a cap, wherein the cap is removably attachable to the container cup to define an interior chamber and form a seal between the cap and the container cup; depositing a quantity of solution within the interior chamber; immersing a lens into the solution in the interior chamber; allowing a pressure to be generated within the interior chamber; and venting gas from the interior chamber when the pressure reaches a threshold pressure, wherein the cap deforms under the influence of the pressure to temporarily release the seal between the cap and the container cup.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
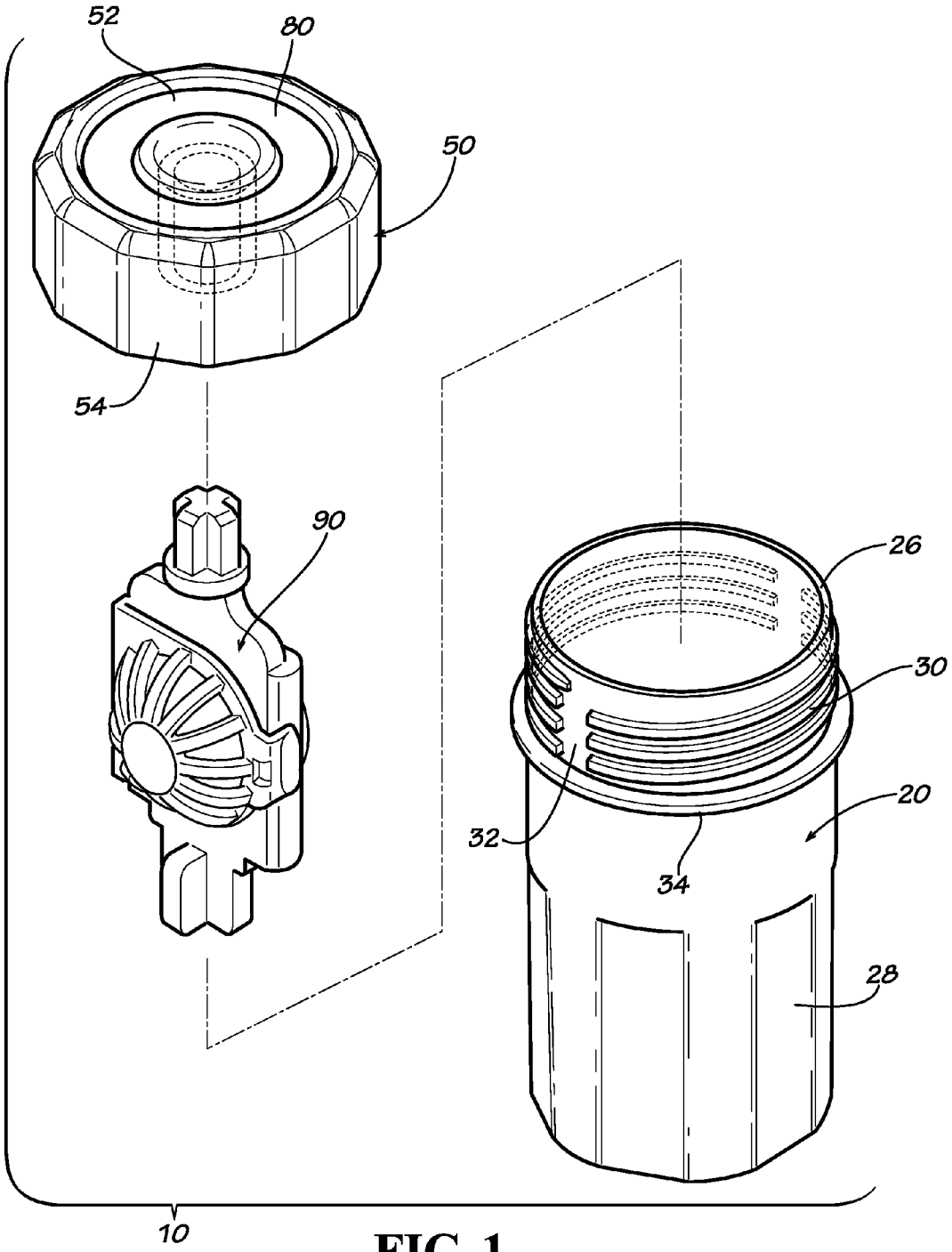
FIG. 1 is an assembly view of a lens care system according to an example embodiment of the present invention.
Figure 2:
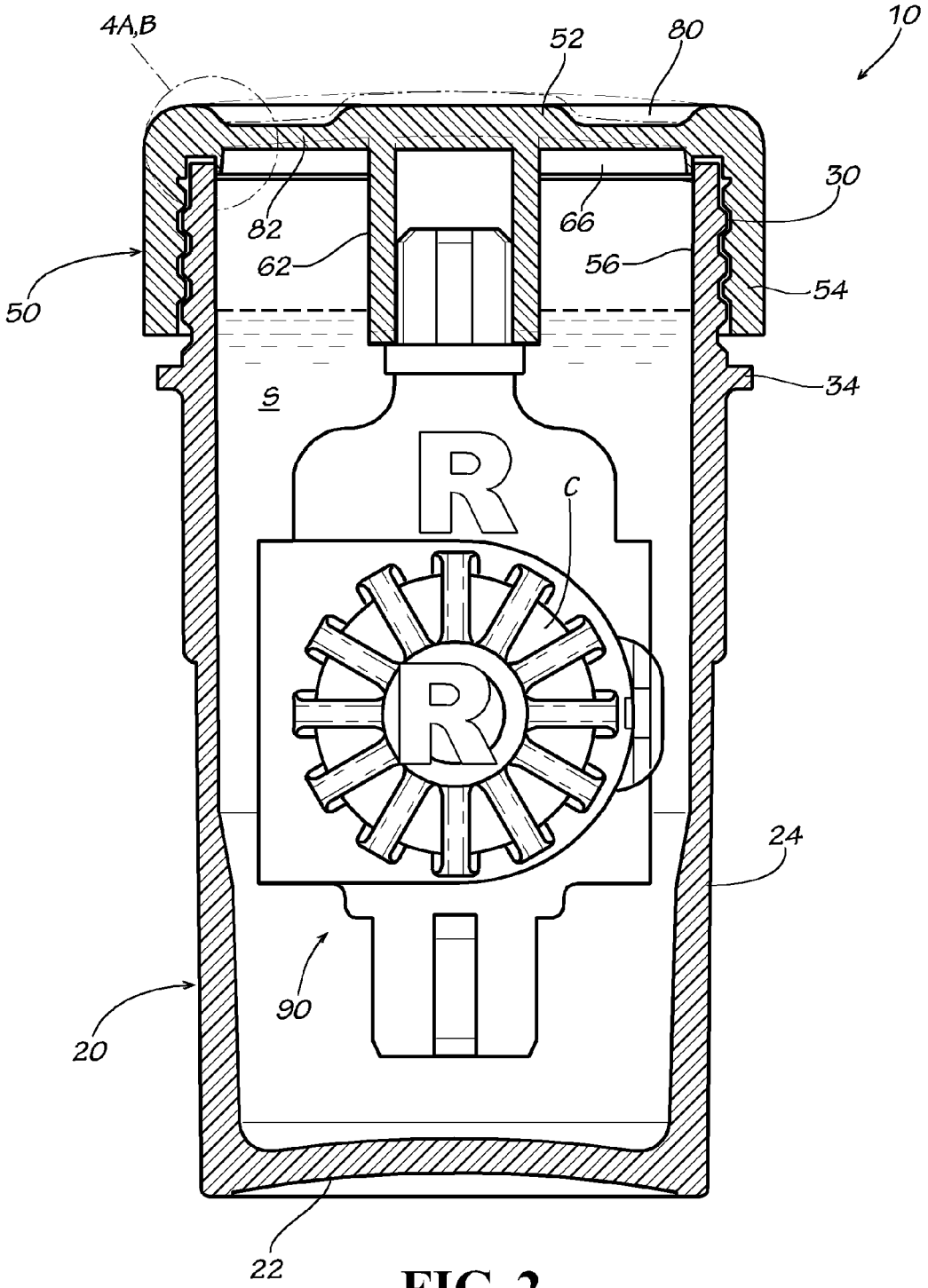
FIG. 2 is a cross-sectional view of the lens care system of FIG. 1 in an assembled state.

With reference now to the drawing figures, wherein like reference numbers represent corresponding parts throughout the several views, FIGS. 1 and 2 show a system 10 for cleaning, disinfecting and/or storing one or more contact lenses or other ophthalmic or medical devices. The lens care system 10 generally comprises a container cup 20, a cap 50 for removable attachment onto the container cup, and a lens holder 90. FIG. 1 shows the components separately, in a disassembled state; whereas FIG. 2 shows the assembled system in an example manner of use, with a contact lens C retained in the lens holder 90 and immersed in a liquid lens care solution S.

The container cup 20 is generally cylindrical, having a bottom panel 22 and a tubular sidewall 24 having a generally circular profile. The container cup defines an interior chamber accessible from an open top end bounded by a circumferential upper rim 26 opposite the bottom panel 22. One or more flats 28 or other surface features are optionally provided on the exterior surface of the sidewall 24 to provide improved grip for a user. The container cup 20 is preferably a unitary component, for example integrally molded of polystyrene, polypropylene, polyethylene, ABS and/or other plastic or polymeric material(s) of construction, as by injection molding or other fabrication process. The container cup 20 comprises a first helical thread profile 30 on its exterior surface proximal the upper rim 26. The first threads 30 are optionally split by one or more unthreaded segments 32, providing a discharge channel for gas vented from the container during use, as will be described below. The unthreaded segment 32 preferably defines a gas venting channel extending generally linearly from the rim 26 of the container cup through the entire threaded portion of the cup, providing a passage for free discharge flow of pressurized gas therethrough from the container when the cap is assembled onto the cup. A circumferential cup flange 34 extends transversely outward from the exterior surface of the sidewall 24 beneath the thread profile 30.

The cap 50 comprises a generally circular top panel 52 and a circumferential collar 54 extending transversely downward from the top panel. The collar 54 has an inner diameter configured to receive the outer diameter of the container cup 20, preferably with a loose or free running fit. The interior face of the collar 54 comprises a second helical thread profile 56, seen best in FIG. 5, which interengages with the first thread profile 30 on the container cup 20 when the cap 50 is screwed onto the container cup to hold the components together in their assembled state. The second threads 56 are optionally split by one or more unthreaded segments 58, providing a discharge channel for gas vented from the container during use. Also, sufficient spacing or play is preferably provided between the first and second thread profiles to permit gas discharge through the threaded interface. The collar 54 optionally comprises one or more flats 60 along its exterior circumference, forming a rounded polygonal profile, to provide improved grip for a user. The cap 50 is preferably a unitary component, for example integrally molded of polypropylene, polyethylene, polystyrene, ABS and/or other plastic or polymeric material(s) of construction, as by injection molding or other fabrication process.

Figure 4A:
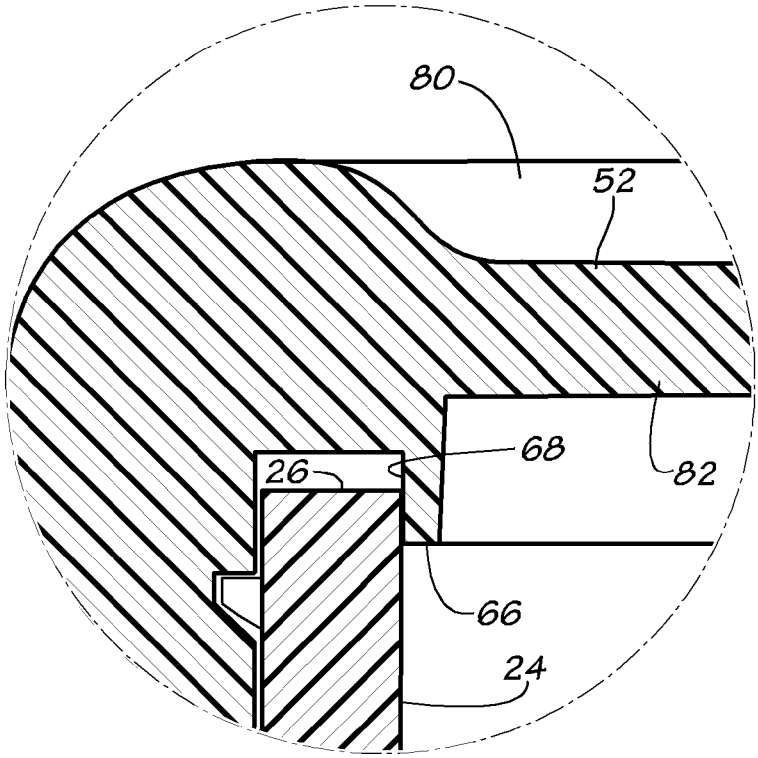
FIG. 4A is a detailed cross-sectional view of the seal area at the closure between the cap and container cup of the lens care system of FIG. 1, in an undeformed or sealed state.

A coupling hub 62 projects downward from the center of the interior face of the top panel 52 of the cap 50, and defines a central receiver 64 for receiving a cooperating retention finger of the lens holder 90, as described below. A resilient cap sealing flange or lip 66 projects downward from the interior face of the top panel 52 of the cap 50. The lip 66 has a continuous circular profile extending proximal the outer periphery of the interior face of the top panel 52 (see FIG. 5), and spaced inwardly from the threaded interior face of the collar 54 a distance generally corresponding to the wall thickness of the sidewall 24 of the container cup 20 (see FIG. 4A). In this manner, when the cap 50 is installed onto the container cup 20, the outer face 68 of the lip 66 interfaces with the interior surface of the container cup along its rim 26 to form a continuous liquid-tight seal in the cap's undeformed state, as shown in FIG. 4A. The outer face 68 of the lip 66 is optionally provided a slight inward taper, to provide a ring of sealing point contact at the edge formed by the intersection of the upper face of the rim 26 and the interior surface of the container cup. The lip 66 is preferably an integral part of the cap 50, rather than a separate component, such that a sealing and venting interface is formed between the cup and the cap with minimal complexity. In this manner, no separate washer or seal component is required to form a seal between the container cup and the cap. In alternate embodiments, the seal interface comprises separate seal and/or vent components attached to the cap and/or cup.

Figure 5:
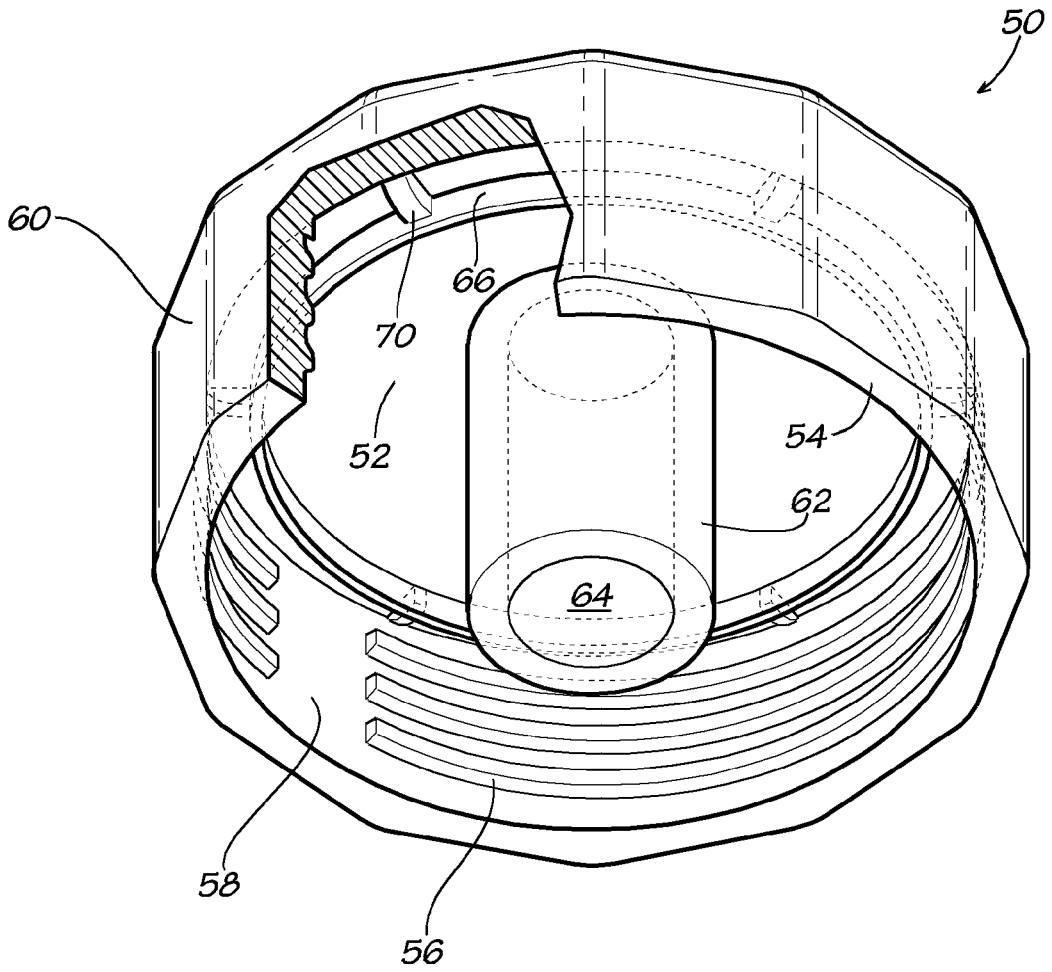
FIG. 5 is a perspective view with partial cutaway of the cap component of the lens care system of FIG. 1.

A spaced array of interference ribs 70 are optionally provided along the interior face of the top panel 52 between the lip 66 and the interior face of the collar 54, as seen best in FIG. 5, to prevent tightening the cap 50 to such an extent that the rim 26 of the container cup 20 would seal against the interior face of the cap's top panel to prevent discharge of gas from the container. Alternatively, one or more recesses can be formed in the interior face of the top panel between the cap's lip and the interior face of its collar to allow gas discharge. Seating of the interference ribs on the interior face of the cap's top panel against the rim 26 of the container cup 20 defines the position of the cap relative to the container cup when the container is closed, and this seating location is controlled to provide a specified degree of interference or compression between the tapered contact face of the cap's sealing lip 66 against the container cup's rim. For example, control of the diameter of the sealing lip 66 and the height of the interference ribs 70 to provide a seal interference of about 25 μm-50 μm between the sealing lip of the cap with the rim of the container cup may provide a suitable releasable seal interface.

Figure 4B:
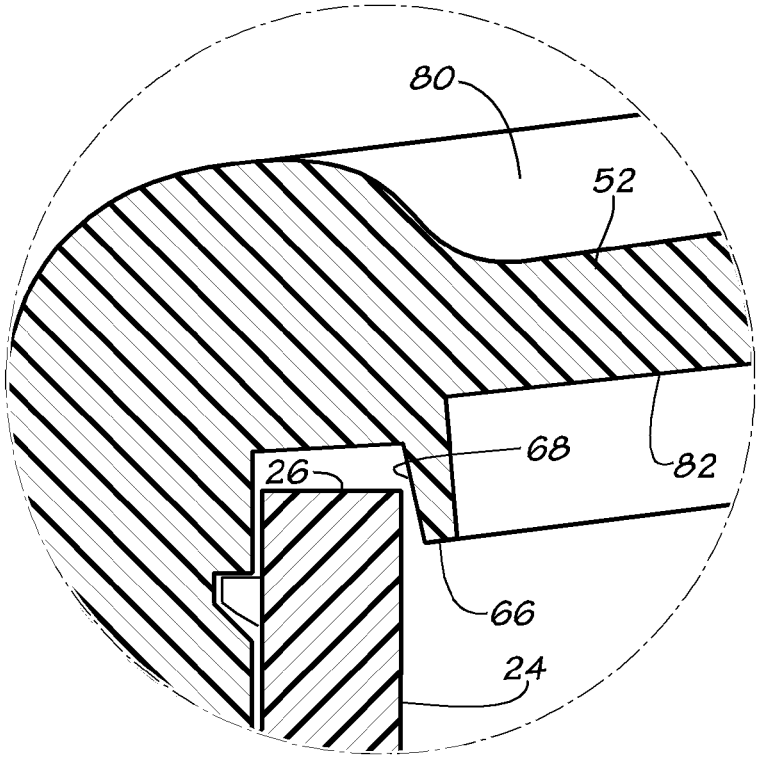
FIG. 4B is a detailed cross-sectional view of the seal area at the closure between the cap and container cup of the lens care system of FIG. 1, in a deformed or venting state.

The top panel 52 of the cap 50 has an annular channel or ring-shaped recess or depression 80 formed in its upper or exterior surface. This channel 80 results in a circular section or web 82 of decreased material thickness around the periphery of the top panel 52. The outer periphery of the section of reduced thickness 82 on the exterior surface of the top panel 52 is generally aligned with and opposite the position of the sealing lip 66 on the interior surface of the top panel. The material of construction of the cap 50 and the thickness and location of this section 82 are specified in conjunction to result in a top panel 52 configuration that allows a degree of flexure of the top panel in response to a threshold pressure within the container. For example, the cap 50 may comprise a polypropylene such as Huntsman/FHR P5M6K-048 polymer, and the web 82 of decreased material thickness have a thickness of between about 0.75 mm-1.75 mm, for example about 1.25 mm, and a diametral span of about 20 mm-30 mm, for example about 25 mm. When a threshold pressure of for example 1-8 pounds per square inch (psi) is reached, the top panel deforms or bulges outwardly from its undeformed state (shown in solid lines in FIG. 2, and in detail view in FIG. 4A) into a deformed state (shown in broken lines in FIG. 2, and in detail view in FIG. 4B with the extent of deformation somewhat exaggerated for emphasis), causing the lip 66 to tilt inwardly and out of contact with the rim 26 of the container cup. Pressurized gas within the contained volume defined by the cup 20 and attached cap 50 may then escape or vent through the threaded interface of the cup and cap, and/or though the gas venting channel formed by the unthreaded segment 32 of the threaded coupling between the container cup and the cap, if present. Because no separate seal or washer component is interposed between the container cup and the cap, the released gas discharges directly between the cap and the container cup, without passing through any intermediate seal chamber or cavity. Release of the excess gas reduces the pressure within the contained volume back below the threshold pressure, and the top panel returns to its undeformed state (FIG. 4A) biased by the cap material's resilience or shape memory. During the cleaning and disinfecting process, continuing gas generation may result in an intermittent sequence or cycle of increasing pressure and venting or "burping" to release excess gas. The resilience of the cap 50 maintains the circular lip 66 of the cap 50 in sealing contact with the rim 26 of the container cup 20 except when venting excess gas, thereby preventing leakage of liquid from the container. In alternate embodiments, the top panel of the cap comprises various other configurations allowing for controlled flexure or deformation and release of excess internal pressure. For example, a recessed section could be formed on the interior and/or exterior surface(s) of the top panel, a plurality of ribs of varying flexure may be formed on the top panel, and/or a series of stepped indentations or rings may be formed on the top panel.

Figure 3:
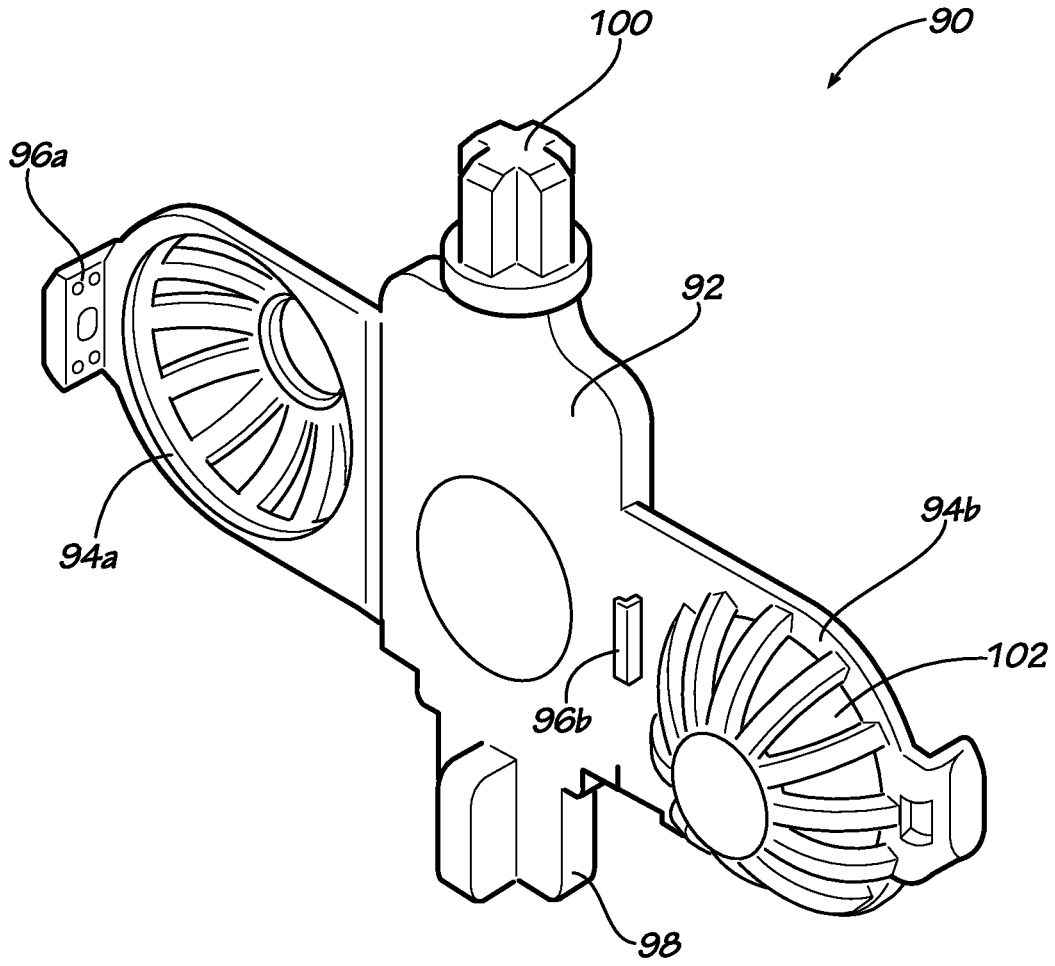
FIG. 3 is a perspective view of the contact lens holder component of the lens care system of FIG. 1, with its lens retaining baskets shown in an open configuration.

The lens holder 90 is shown in detail in its open state in FIG. 3 and in its closed state in FIG. 1. The lens holder comprises a body panel 92 having first and second lens basket panels 94*a*, 94*b* attached thereto by an integral or living hinge formed by a web of reduced material thickness. Interengaging clips or closure members 96*a*, 96*b* are provided for holding the lens basket panels in their closed state, and releasing with finger pressure to allow insertion and removal of a lens from the basket. A base 98 extends from a lower end of the body panel 92, and a retention finger 100 extends from an upper end of the body panel. The base 98 and the retention finger 100 optionally define a cross-shaped profile for stability. The base 98 is optionally configured to engage a catalyst element such as for example a platinum disk (see for example, U.S. Pat. No. 5,196,174, incorporated herein by reference). The retention finger 100 has an outer periphery configured to form an interference or clearance fit within the receiver 64 of the coupling hub 62 of the cap 50. The basket panels 94 are perforated with a plurality of slots or openings 102 to allow lens care solution to flow therethrough.

In use, the container 10 is opened by unscrewing the cap 50 from the container cup 20. A liquid such as a hydrogen peroxide based lens care solution is dispensed into the container cup to a desired fill level. A catalase tablet or other catalyst component is deposited into the container cup. One or more contact lenses are placed in the lens holder 90 between the body panel and the basket panels, and the basket panels are closed and clasped. The retention finger of the lens holder is inserted into the receiver of the cap's hub. The lens holder and lenses are inserted into the container cup and immersed in the lens care solution. The cap is screwed onto the container cup to close the container, bringing the sealing lip of the cap into sealing interface with the rim of the container cup to prevent liquid leakage. As the cleaning and disinfecting process progresses, the hydrogen peroxide ($H_2O_2$) in the lens care solution is broken down into liquid water ($H_2O$) and oxygen gas ($O_2$). The released oxygen gas generates a positive pressure differential within the contained volume of the system, relative to the external atmosphere. When this internal pressure reaches a threshold pressure, the top panel of the cap flexes or deforms, disengaging the sealing interface between the lip of the cap and the rim of the container cup. Excess gas is released between the cap lip and cup rim, over the cup rim between the interference ribs, and through the threaded interface between the first and second thread profiles and/or through the unthreaded segments of the split threads. As the gas is released, the pressure drops below the threshold pressure, and the cap flexes back to its undeformed state, sealing the cap lip and cup rim against leakage. The sequence of pressure build-up and release continues until the cleaning and disinfecting process is complete. The lenses may continue to be stored in the container, or removed by unscrewing the cap from the container cup. The system is preferably reusable, and the used lens care solution can be disposed of and the process repeated.

While the invention has been described with reference to preferred and example embodiments, it will be understood by those skilled in the art that a variety of modifications, additions and deletions are within the scope of the invention, as defined by the following claims.

What is claimed is:

1. A lens care container comprising:

a container cup defining an interior chamber accessible through an opening bounded by a rim; and a cap removably attachable to the container cup to cover the opening, the cap comprising a deformable panel and a resilient sealing lip, wherein the resilient sealing lip projects downward from the interior face of the deformable panel, wherein the deformable panel is the top panel of the cap and has an annual or ring-shape section of decreased material thickness, wherein the container cup comprises a first thread profile and the cap comprises a second thread profile interengagable with the first thread profile to secure the cap to the container, wherein at least one of the first and second thread profiles comprise a split thread profile having an unthreaded segment defining a gas venting channel for allowing venting of gas therethrough, wherein the sealing lip engages and seals against the rim of the container cup when the deformable panel is substantially undeformed, and allows venting of gas between the sealing lip and the rim of the container cup when the panel is deformed.

2. The lens care container of claim 1, further comprising a lens holder.

3. The lens care container of claim 2, wherein the lens holder comprises at least one basket for retaining a contact lens.

4. The lens care container of claim 2, wherein the lens holder comprises a retention finger configured to be received within a receiver of the cap.

5. The lens care container of claim 1, wherein sufficient spacing is provided between the first and second thread profiles to allow venting of gas therethrough.

6. The lens care container of claim 1, wherein the deformable panel of the cap moves from its undeformed state to its deformed state under the influence of a threshold pressure within the interior chamber when the cap is attached to the container cup.

7. The lens care container of claim 1, wherein the sealing lip comprises a tapered profile for contact with the rim of the container cup.

8. The lens care container of claim 1, wherein the cap comprises a spaced array of interference ribs for contacting the rim of the container cup and permitting venting of gas between the cap and the rim.

9. The lens care container of claim 1, wherein the cap comprises a unitary, integral molding.

10. The lens care container of claim 1, wherein the container cup comprises a unitary, integral molding.

11. The lens care container of claim 1, wherein the sealing lip of the cap engages and seals directly against the rim of the container cup, without an intermediate sealing component.

12. A lens care container comprising:

a container cup consisting essentially of a unitary, integral molding, and defining an interior chamber for receiving a lens care solution; and a cap for removable attachment to the container cup to seal the lens care solution within the interior chamber, the cap consisting essentially of a unitary, integral molding;

wherein the cap further comprises a deformable panel and the sealing lip of the cap seals against the rim when the deformable panel is in a substantially undeformed state, and permits venting of gas therebetween when the deformable panel is in a deformed state, wherein the deformable panel is the top panel of the can;

wherein the container cup comprises a first thread profile and the cap comprises a second thread profile interengagable with the first thread profile to secure the cap to the container, wherein at least one of the first and second thread profiles comprise a split thread profile having an unthreaded segment defining a gas venting channel for allowing venting of gas therethrough, wherein an interface between the cap and the container cup upon closure of the cap onto the container cup permits venting of gas from the interior chamber.

13. The lens care container of claim 12, wherein the interface between the cap and the container cup comprises a sealing lip portion of the cap which seals against a rim of the container cup.

14. The lens care container of claim 12, wherein the deformable panel of the cap moves from its undeformed state to its deformed state under the influence of a threshold pressure within the interior chamber when the cap is attached to the container cup.

15. The lens care container of claim 13, wherein the sealing lip comprises a tapered profile for contact with the rim of the container cup.

16. The lens care container of claim 13, wherein the cap further comprises a spaced array of interference ribs for contacting the rim of the container cup and permitting venting of gas between the cap and the rim.

* * * * *